US010206543B2

(12) United States Patent
Maner

(10) Patent No.: US 10,206,543 B2
(45) Date of Patent: Feb. 19, 2019

(54) SHOWER CURTAIN RESTRAINER

(71) Applicant: William Lawrence Maner, Galveston, TX (US)

(72) Inventor: William Lawrence Maner, Galveston, TX (US)

( * ) Notice: Subject to any disclaimer, the term of this patent is extended or adjusted under 35 U.S.C. 154(b) by 0 days.

(21) Appl. No.: 15/065,840

(22) Filed: Mar. 9, 2016

(65) Prior Publication Data

US 2016/0262577 A1 Sep. 15, 2016

Related U.S. Application Data

(60) Provisional application No. 62/131,727, filed on Mar. 11, 2015.

(51) Int. Cl.
*A47K 3/38* (2006.01)

(52) U.S. Cl.
CPC ..... *A47K 3/38* (2013.01)

(58) Field of Classification Search
CPC ..... A47K 3/38; A47H 23/01
USPC ..... 4/558, 608, 610, 609; 160/330, 349.1, 160/349.2, DIG. 6; 24/3.1, 3.11, 3.12, 24/3.13, 72.5, 298, 299, 300, 301, 302
See application file for complete search history.

(56) References Cited

U.S. PATENT DOCUMENTS 1,448,811 A * 3/1923 Morrison ..... A47G 21/167 160/349.1
2,120,155 A * 6/1938 Shera ..... A47K 3/38 16/404
2,173,993 A 9/1939 Amdur
2,188,163 A 1/1940 Sherman
2,232,194 A * 2/1941 Zogby ..... A47K 3/38 160/349.1
2,293,883 A 8/1942 Bossert
2,765,487 A * 10/1956 Foster ..... D06F 55/00 16/404
2,817,850 A 12/1957 Barbour et al.
3,382,507 A 5/1968 Micheau
3,741,701 A 6/1973 Nelson
3,872,520 A 3/1975 Tyconik
4,361,914 A 12/1982 Oliver
4,723,326 A 2/1988 Tarlow et al.
5,007,120 A 4/1991 Annand
5,097,541 A 3/1992 Annand
(Continued)

FOREIGN PATENT DOCUMENTS

DE 9300047 U1 * 2/1993 ..... A47K 3/38
DE 29606634 U1 * 7/1996 ..... A47K 3/38

OTHER PUBLICATIONS

Machine Translation for DE 29606634.*

*Primary Examiner* — Erin Deery
(74) *Attorney, Agent, or Firm* — Parsons & Goltry; Robert Parsons; Michael Goltry

(57) ABSTRACT

A shower curtain restrainer for use with a shower curtain, includes an elongated body having an engagement end and an opposing weight end. An engagement member is coupled to the engagement end and is couplable to the shower curtain intermediate a top edge and a bottom edge thereof. A weight element is coupled to the weight end. When coupled to a shower curtain, a fulcrum point is formed at a rim of a bathtub contacted by the elongated body intermediate the engagement end and the weight end. This fulcrum imparts a horizontal force on the attached shower curtain, outwardly toward the rim.

8 Claims, 5 Drawing Sheets

(56) References Cited

U.S. PATENT DOCUMENTS

| | | | | |
|---|---|---|---|---|
| 5,615,454 | A * | 4/1997 | Contarino | A45C 13/20 24/116 A |
| 5,894,642 | A * | 4/1999 | Eberhardt | A47H 13/16 160/124 |
| 6,041,454 | A | 3/2000 | Summerford | |
| 6,345,747 | B1 * | 2/2002 | Ogata | A45C 13/18 224/257 |
| 6,550,525 | B1 | 4/2003 | Grisolia | |
| 6,591,432 | B1 | 7/2003 | Feinstein et al. | |
| 7,337,501 | B2 * | 3/2008 | Vermillion | A45F 5/02 24/298 |
| 7,503,079 | B1 * | 3/2009 | Fletcher | A42B 5/00 2/207 |
| 7,686,062 | B1 * | 3/2010 | Darnell | A47H 21/00 160/123 |
| 7,966,700 | B2 * | 6/2011 | Vermillion | A45F 5/02 24/3.12 |
| 2002/0108724 | A1 | 8/2002 | Grahn | |
| 2006/0085904 | A1 | 4/2006 | Tsvok | |
| 2006/0200901 | A1 | 9/2006 | Beyda | |
| 2008/0201839 | A1 | 8/2008 | Dalton | |
| 2008/0289095 | A1 | 11/2008 | Li | |
| 2011/0094985 | A1 | 4/2011 | Austin | |
| 2013/0061386 | A1 * | 3/2013 | Vagliardo | A47K 3/38 4/558 |
| 2013/0067704 | A1 | 3/2013 | Raymond | |
| 2015/0223643 | A1 * | 8/2015 | Mason | A47K 3/38 4/608 |

* cited by examiner

SHOWER CURTAIN RESTRAINER

CROSS-REFERENCE TO RELATED APPLICATION

This application claims the benefit of U.S. Provisional Application No. 62/131,727, filed 11 Mar. 2015.

FIELD OF THE INVENTION

This invention relates to shower/bath accessories.

More particularly, the present invention relates to shower curtain accessories.

BACKGROUND OF THE INVENTION

For many years, shower curtains have had a clear utilitarian use, namely to contain sprays and splashes within the confines of the tub. However, bathers using showers have been frustrated by the fact that shower curtains tend to move inward against the bather while the shower is in use. This is an annoyance at best, and also possibly a safety hazard at worst, when considering the impediment to movement and vision that the shower curtain may cause when it moves close to the bather. This is particularly the case when a bather is elderly, handicapped, or young, and this becomes especially precarious on the slick walking surface of the wet tub in which the bather is standing. Often called the "shower-curtain effect", this effect is thought to be caused by any one or more of the following principles:

Buoyancy theory: Also called Chimney effect or Stack effect, observes that warm air (from the hot shower) rises out over the shower curtain as cooler air (near the floor) pushes in under the curtain to replace the rising air. However, the shower-curtain effect persists when cold water is used, implying that this cannot be the only mechanism at work.

Bernoulli Effect theory: The most popular explanation given for the shower-curtain effect is the Bernoulli's principle. Bernoulli's principle states that an increase in velocity results in a decrease in pressure. This theory presumes that the water flowing out of a shower head causes the air through which the water moves to start flowing in the same direction as the water. This movement would be parallel to the plane of the shower curtain. If air is moving across the inside surface of the shower curtain, Bernoulli's principle says the air pressure there will drop. This would result in a pressure differential between the inside and outside, causing the curtain to move in an inward direction. This effect would be strongest when the gap between the bather and the curtain is smallest—resulting in the curtain clinging to the bather.

Horizontal vortex theory: A recent computer simulation of a typical bathroom found that none of the above theories pan out in their analysis, but instead found that the spray from the shower-head drives a horizontal vortex. This vortex has a low-pressure zone in the center, which then sucks the curtain in toward the bather.

Condensation: A hot shower will produce steam that condenses on the shower side of the curtain; lowering the pressure there. In a steady state the steam will be replaced by new steam delivered by the shower, but in reality the water temperature will fluctuate and lead to times when the net steam production is negative, resulting in movement of the shower curtain.

What is needed is a cost-effective, safe, and easy-to-implement device and method to prevent the motion and potentially hazardous action of the shower curtain. A number of devices in the prior art have been proposed to purportedly solve this problem, including vertical ribs or bars extending downwardly from the shower curtain rod, weights attached to the bottom edge of the shower curtain, and horizontal rods or lines extending between walls behind the shower curtain. While many of these devices are potentially effective, they can be expensive, difficult to install and often unsatisfactory in use.

It would be highly advantageous, therefore, to remedy the foregoing and other deficiencies inherent in the prior art.

An object of the present invention is to provide a shower curtain restrainer.

Another object of the present invention is to provide a shower curtain restrainer which is effective and easy to use.

SUMMARY OF THE INVENTION

Briefly, to achieve the desired objects and advantages of the instant invention, provided is a shower curtain restrainer including an elongated body having an engagement end and an opposing weight end. An engagement member is coupled to the engagement end and is couplable to a shower curtain intermediate a top edge and a bottom edge thereof. A weight element is coupled to the weight end. The elongated body has a length capable of spanning a distance between a selected point on the shower curtain and a point below an edge of the rim of the bathtub.

In a more specific aspect, a shower curtain restrainer is provided, including a shower curtain having a top edge and a bottom edge and a bathtub having a rim. The shower curtain overhangs the bathtub, with the top edge spaced above the rim and the bottom edge spaced below the rim and inside the bathtub. The restrainer includes an elongated body having an engagement end and an opposing weight end. An engagement member is coupled to the engagement end and coupled to the shower curtain intermediate the top edge and the bottom edge. A weight element is coupled to the weight end and positioned below the rim outside the bathtub. A fulcrum point is formed at the rim contacted by the elongated body intermediate the engagement end and the weight end, imparting a horizontal force on the shower curtain, outwardly toward the rim.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
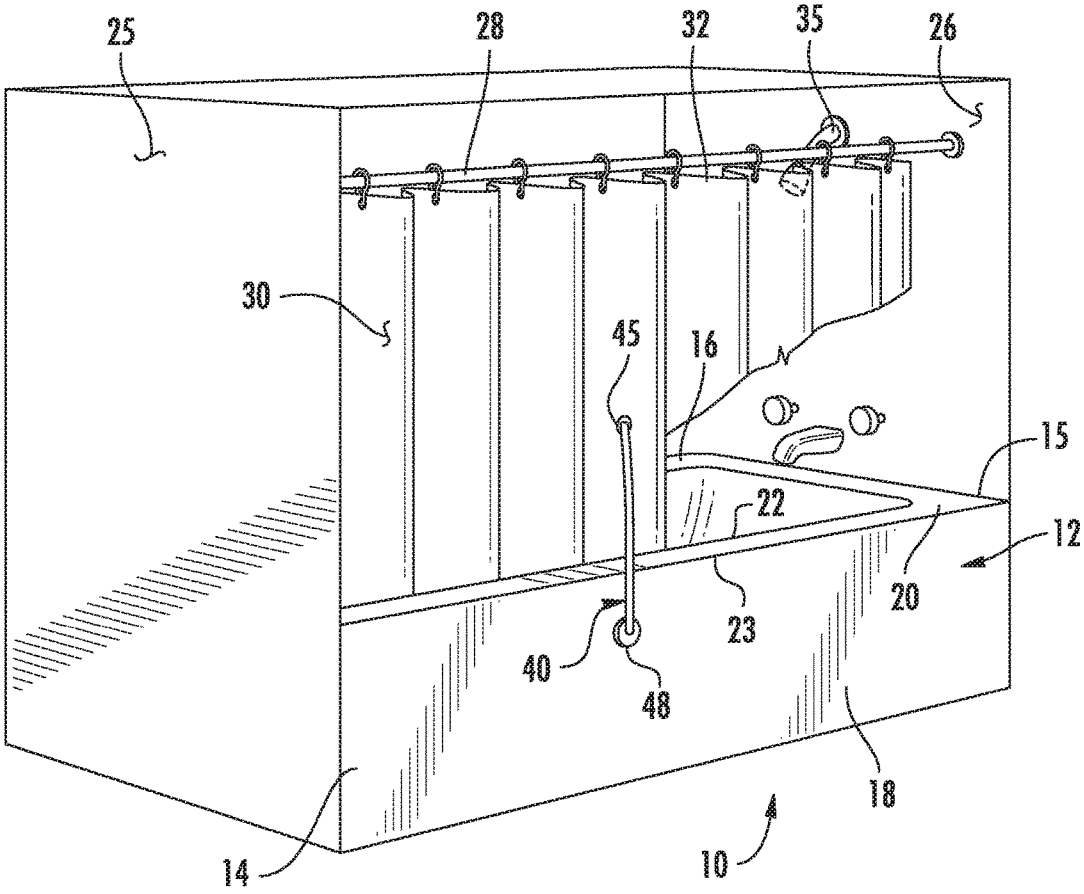
FIG. 1 is a perspective view of a shower enclosure utilizing an embodiment of the shower curtain restrainer according to the invention.

Turning now to the drawings in which like reference characters indicate corresponding elements throughout the several views, attention is directed to FIG. 1 which illustrates a shower enclosure, generally designated 10. Shower enclosure 10 includes a bath tub 12 having opposing ends 14 and 15, a back 16 and a front 18. Bathtub 12 includes a rim 20 extending therearound. Rim 20, and in particular, rim 20 at front 18 includes an inner edge 22 and an outer edge 23. In this specific embodiment, an end wall 25 is adjacent end 14 of a bathtub 12 and an end wall 26 is spaced from end wall 25 adjacent end 15 of bathtub 12. A shower curtain rod 28 extends between end walls 25 and 26, suspended above rim 20 at front 18. A shower curtain 30 is carried by shower curtain rod 28 and includes an upper edge 32 and a lower edge. Shower curtain 30 is coupled to rod 28 such that the lower edge is positioned to hang below rim 20 adjacent inner edge 22, inside bathtub 12. A shower head 35 is mounted on end wall 26. It will be understood that while shower enclosure 10 is a bathtub positioned between end walls in this embodiment, a free standing tub with associated shower curtain positioned at or within any or all sides of the tub can also benefit from the present invention. It will also be understood that the device can be employed even for tubs where rim 20 has a rounded, beveled, or tapered surface with no edges. In other words, the present invention can be employed with substantially any shower arrangement using a tub and a shower curtain or curtains.

Figure 2:
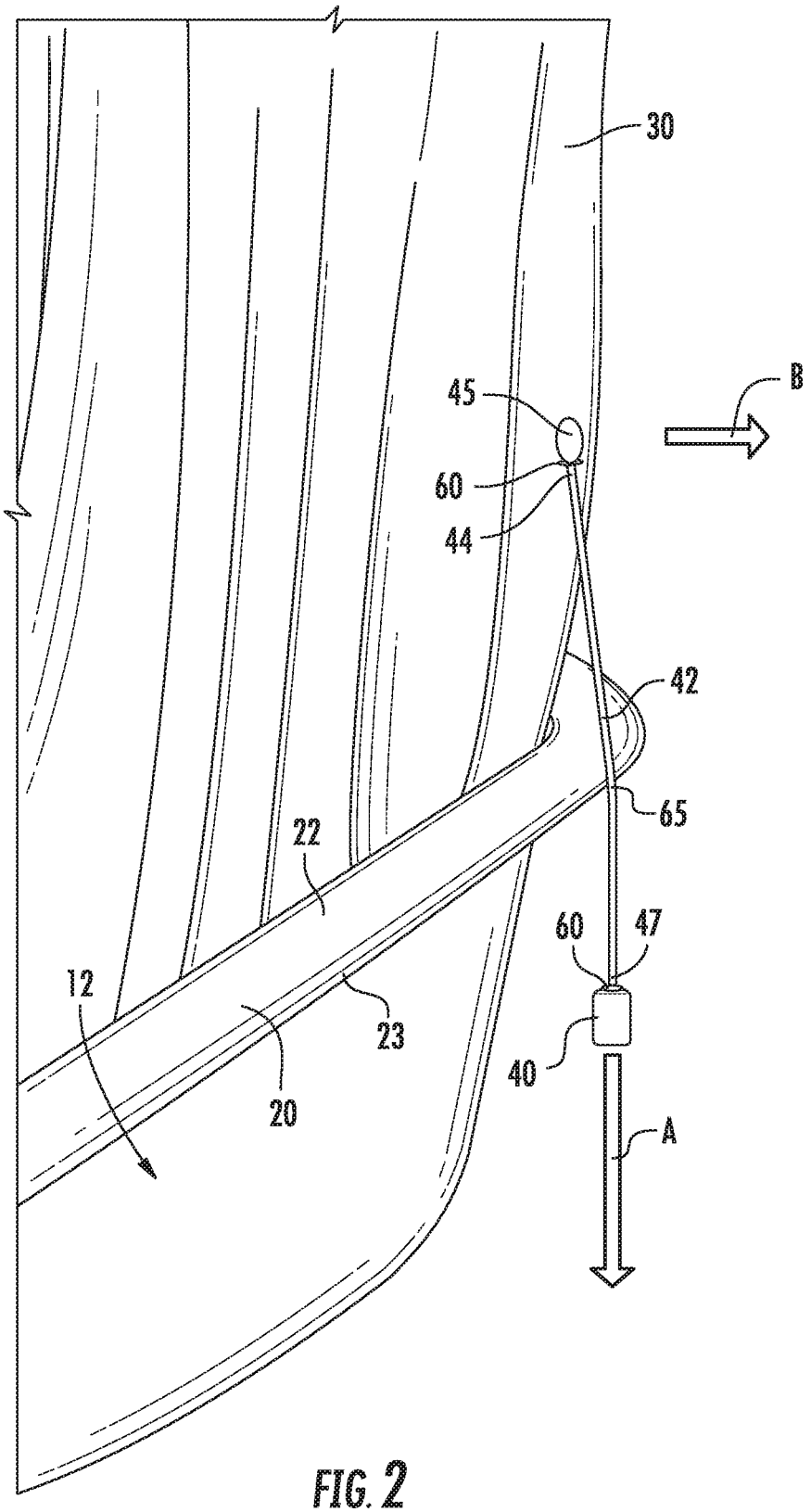
FIG. 2 is an enlarged partial perspective view of the shower enclosure and shower curtain restrainer of FIG. 1.
Figure 3:
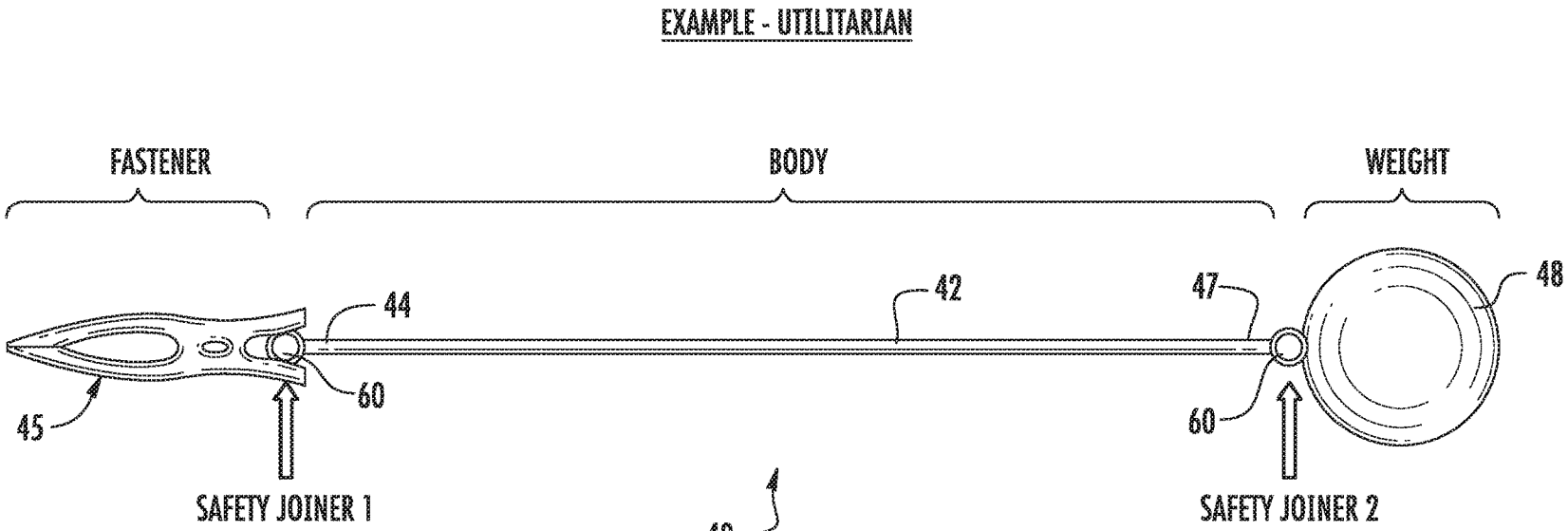
FIG. 3 is a side view of the shower curtain restrainer of FIGS. 1 and 2.
Figure 4:
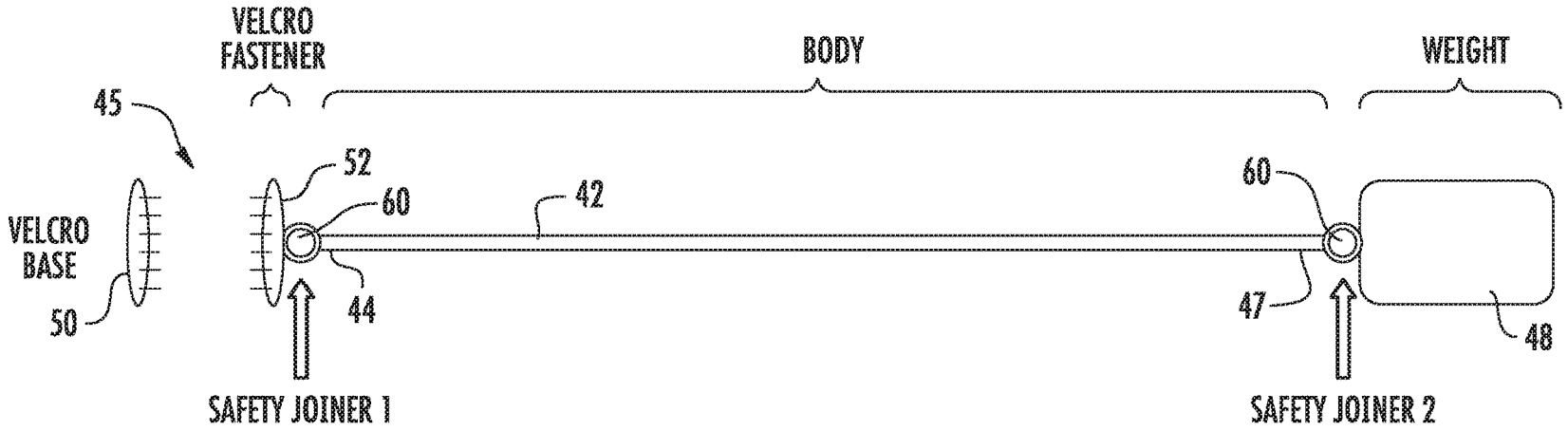
FIG. 4 is a side view of another embodiment of the shower curtain restrainer of FIGS. 1 and 2.

Still referring to FIG. 1, with additional reference to FIGS. 2, 3 and 4, a shower curtain restrainer generally designated 40 is illustrated. Restrainer 40 includes an elongated body 42 having an engagement end 44 coupled to an engagement member 45 and an opposing weight end 47 coupled to a weight element 48. Elongated body 42 is an element or assembly which is intended to span a distance between a selected point on shower curtain 30, in this preferred embodiment at the level of or above rim 20, and a point below outer edge 23 of rim 20. Elongated body 42 can be formed of string, yarn, twine, thread, tassel, line, lanyard, rod, prism, column, cylinder, chain, rope, cord, lace, tie, tubing, hosing, beadwork, flap, strap, strip, net, and the like or other elongated mass, or a plurality of these, composed of either flexible or rigid materials, such as cloth, fiber, metal, Teflon, plastic, rubber, latex, silicon, or nylon, and the like. It will also be understood that elongated body 42 can be adjustable in length to be adaptable to various sizes and weights of shower curtains. Elongated body 42 can also be elastic, telescoping, or retractable to extend its length when weight element 48, having greater weight is employed, or reduce its length when a lesser weight is employed.

Engagement member 45 is an element or assembly capable of coupling engagement end 44 of elongated body 42 to a portion of shower curtain 30 intermediate upper edge 32 and the lower edge, at the level of or above rim 20 of bathtub 12 in this preferred embodiment, but can also be positioned below the rim as will be described presently. Engagement member 45 can be mechanical such as a clip, pin, tie, fastener, hook, snap, button, grommet, catch, clasp, ring, grip, suction-cup, snap-fit and the like, an adhesive or chemically coated face, or magnetic, or spring-tensioned device, or the like, or a plurality of any of these, for gripping or attaching to a material roughly the size, shape, and substance of a shower curtain, and specifically capable of attaching to an inner surface or outer surface of a shower curtain. With reference to FIG. 3, engagement member 45 is a spring biased clamp having two jaws which clamp about a fold in shower curtain 30 at the desired location above rim 20 and below upper edge 32. With reference to FIG. 4, engagement member 45 is a two part engagement element such as Velcro, having a base 50 carrying an element (i.e. Velcro loop material) attached to shower curtain 30 such as by adhering, sewing or the like, and a complemental element 52 (Velcro hook material) coupled to engagement end 44 of body 42. Base 50, which is itself attached to a shower curtain, may be affixed to said shower curtain in a permanent manner (Examples: permanent glue, permanent adhesive, or the like) or temporary manner (Examples: temporary adhesive, magnetic, or the like). Base 50 may itself be composed of multiple elements (Examples: two magnets, one positioned on the inner surface of the shower curtain and the other on the outer surface of the shower curtain) or may have components that pierce the shower curtain and engage the inner surface.

Weight element 48 is an element or assembly capable of displacing a portion of shower curtain 30. Weight element 48 can be an object or plurality of objects which is or are composed of material(s), shape(s), or size(s), which is of sufficient total mass for the device to provide a horizontal force adequate to resist the inward force of at least a portion of a shower curtain when the associated shower is in operation, with such horizontal force typically being on the order of 0.01 to 20.00 pounds, and generally not of such large volumetric proportion as to pose a significant walking or movement hazard or impediment in the limited space of most bathrooms.

Engagement end 44 is coupled to engagement member 45, and weight end 47 is coupled to weight element 48 each by a coupling 60, which may serve as a connector, joint, or hinge. Coupling 60 can be a direct coupling such as adhesives, or by an intermediate coupling such as buckles, clips, straps, snaps, hooks, ties, clasps, fasteners, buttons, grommets, catches, latches, snap-fit devices, magnets, Velcro, and the like. The coupling can be achieved by means such as chemical, mechanical, or other physical process, or a plurality of these, which is used in any manner to attach, connect, or otherwise join the engagement member, the elongated body, and the weight member to one another or to any other component of the device, such as welding, melting, fusing, clasping, snapping, clipping, catching, hooking, latching, fastening, molding, gluing, zipping, tying, velcroing, buttoning, snap-fitting, or other mechanical, chemical, or physical means. Either or all of couplings 60 may also constitute a safety joiner. A safety joiner is a coupling, which will release, break apart, pull apart, fall apart, detach, or otherwise disengage upon a predetermined tension. Thus, for example, a snap engagement or Velcro attachment will disengage if an individual steps thereon, to prevent tripping or other disadvantageous activity. One or all couplings 60 being a safety joiner allows one or more shower curtain restrainers 40 to be used without creating a safety risk to individuals using the shower. By releasing body 42 and/or weight 48, tripping and entanglement with shower curtain restrainer 40 is eliminated. The safety joiner can include snug-fit, slip-fit, compression fit, or spring-wound assemblies or mechanisms, or with stretchable or malleable material components under strain, force, or pressure, which, when overcome by sufficient external strain, force, or pressure, releases or the components thereof detach, thus minimizing the risk of tripping or entanglement with the invention.

Referring back to FIG. 2, in operation, engagement member 45 is attached to shower curtain 30 at the desired location above rim 20 and below upper edge 32. Elongated body 42 hangs from engagement member 45 and terminates in weight element 48 suspended below rim 20 outside tube 12. Elongated body 42 is directed or oriented generally outwardly from engagement end 44 to outer edge 23 of rim 20, then falls vertically again to weight element 48 below outer edge 23 of rim 20. This point at edge 23, intermediate end 44 and end 47, acts as a fulcrum point 65. With the force of gravity pulling weight downwardly along arrowed line A, body 42 above fulcrum point 65 imparts a force on shower curtain 30 which includes a horizontal force component along arrowed line B created by fulcrum point 65. The horizontal force component urges shower curtain 30 outwardly toward rim 20 against the inwardly directed force generated by the running shower. In this manner, the shower curtain is maintained against rim 20 by one or more shower curtain restrainers 40.

Figure 5:
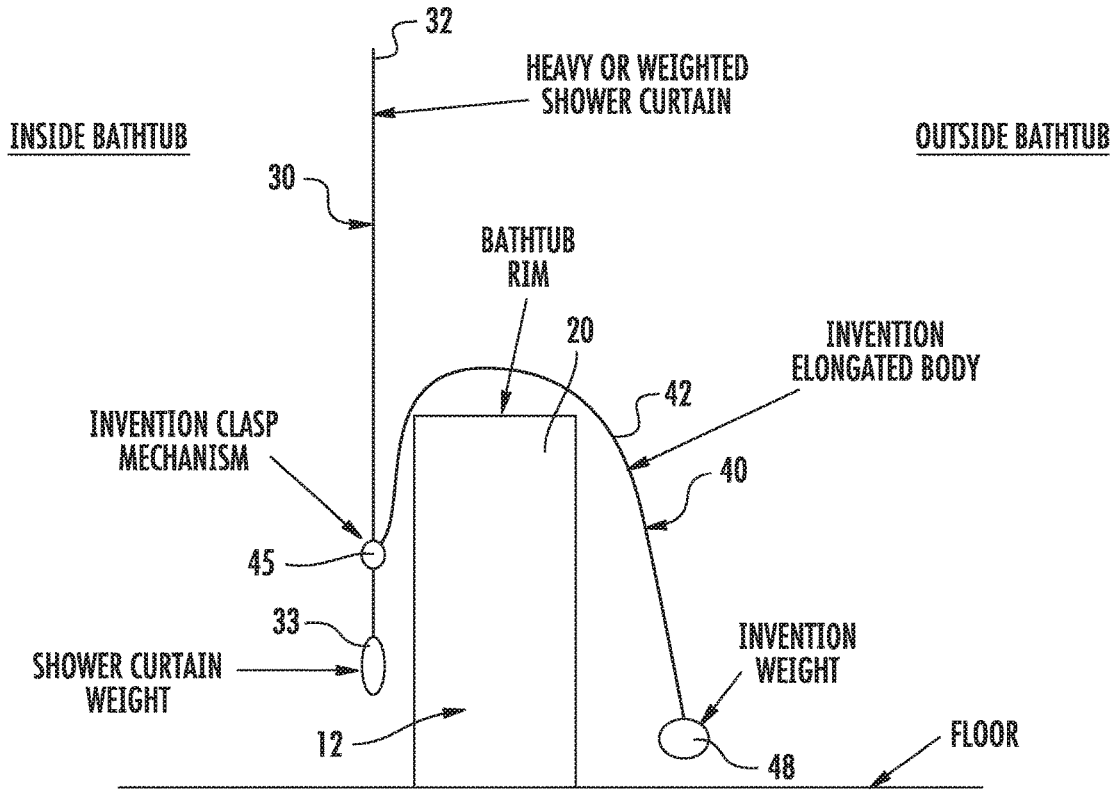
FIG. 5 illustrates a simplified side view of the shower curtain restrainer according to the present invention as it would appear coupled to the shower curtain below the rim of the bathtub.

Turning now to FIG. 5, a portion of rim 20 of bathtub 12 is illustrated. A portion of shower curtain 30 is also illustrated and includes upper edge 32 and a lower edge 33. Shower curtain 30 is hung such that lower edge 33 is positioned to hang below rim 20, inside bathtub 12. While shower curtain restrainer 40 is preferably attached to the shower curtain above rim 20 as illustrated in FIG. 1, it will be understood that it can be employed in certain circumstances with engagement member 45 coupled to shower curtain 30 intermediate upper edge 32 and lower edge 33, but also below rim 20 of bathtub 12. In this instance, elongated body 42 extends from shower curtain 30 with engagement end 44 below rim 20 inside bathtub 12. Elongated body 42 extends over rim 20 and depends downwardly on the outside of bathtub 12 below rim 20, terminating in weight element 48. As long as shower curtain 30 is of sufficient weight, or has a weighted lower edge 33, the upward pull from shower curtain restrainer 40 will be resisted, while the horizontal force component will still maintain an outwardly directed pressure on shower curtain 30 as previously described.

Various changes and modifications to the embodiments herein chosen for purposes of illustration will readily occur to those skilled in the art. For example, bases 50 may employ magnetism, snaps, snap-fits, buttons, buckles, grommets, Velcro, ties, clasps, hooks, latches, zips, catches, clips, fasteners, and the like for a means of function as part of engagement member 45. As another example, engagement member 45 may be adjustable as to tension or force applied on the shower curtain. As another example, couplings or safety joiners 60 may be adjustable as to the detachment force required for them to disengage. As another example, the length of curtain restrainer 40, or any of its elements or components, may be adjustable. As another example, shower curtain restrainers 40 can be provided as an unassembled kit with many possible selections of different aesthetic and utilitarian pieces and components (engagement members 45, bodies 42, bases 50, safety joiners 60, and weights 48) that may be chosen and then assembled into whatever configuration is desired, for optimum function when applied to specific shower curtain and tub arrangements, and to match the decor of the environment. The embodiments wherein a base, safety joiner, engagement member 45, body 42, and/or weight 48 are each constructed of multiple sub-pieces, each sub-piece of which may be different in material makeup, shape, design, or construction. Examples: The engagement member is constructed of a round brass piece and a square silver piece; the body is constructed of a long cylindrical rubber piece and several other oval pieces made of latex; the weight is composed of a cubic wooden piece and a spherical titanium piece; etc. Many different ornamental aspects of each of the elements can be used, such as each being figurine-like, ornamental, cartoonish, symbolic, or otherwise aesthetic or carry meaning in their own way, or wherein the overall assembly of the base, safety joiner, engagement member, body, and/or weight (together composing the device) form a cartoon, figure, figurine, symbol, representation, or ornament having or conveying concept or meaning (Examples: [A.] The engagement member and base can form the top and "arms" of a crucifix; while the body and weight can make up the upright of the same crucifix; or [B.] the engagement member can make up the head of a clown; while the body(ies) can make up the clown's body and arms; and the weight(s) can make up the clown's legs; etc.). As another example, shower curtain restrainers 40 can be provided as manufactured or built into, onto, or as part of, a shower curtain. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A shower curtain restrainer comprising:
- a shower curtain having a top edge and a bottom edge;
- a bathtub having a rim;
- the shower curtain overhanging the bathtub, with the top edge spaced above the rim, and the bottom edge spaced below the rim and inside the bathtub;
- an elongated body having an engagement end and an opposing weight end;
- an engagement member coupled to the engagement end and selectively attached to the shower curtain intermediate the top edge and the bottom edge, the engagement end is coupled to the engagement member by a safety joiner which will disengage upon application of a predetermined tension, releasing the engagement member from the engagement end, the engagement member remaining coupled to the shower curtain upon disengagement of the safety joiner;
- a weight element coupled to the weight end and positioned below the rim outside the bathtub;
- wherein a fulcrum point is formed at a portion of the rim contacted by the elongated body intermediate the engagement end and the weight end, imparting a horizontal force on the shower curtain outwardly toward the rim.

2. The shower curtain restrainer as claimed in claim 1 wherein the elongated body has a length spanning a distance between a selected point on the shower curtain and a point below the rim of the bathtub, outside of the bathtub.

3. The shower curtain restrainer as claimed in claim 2 wherein the engagement member is one of a mechanical fastener, magnetic fastener and an adhesive fastener coupled to an outer surface of the shower curtain.

4. The shower curtain restrainer as claimed in claim 2 wherein the weight element is of sufficient weight to displace a portion of the shower curtain.

5. The shower curtain restrainer as claimed in claim 2 wherein the weight element is of sufficient total mass for the shower curtain restrainer to provide a horizontal force adequate to resist the inward force of at least a portion of the shower curtain when an associated shower is in operation.

6. A shower curtain restrainer as claimed in claim 1 further comprising:
- a second elongated body having an engagement end and an opposing weight end;
- a second engagement member coupled to the engagement end of the second elongated body and coupled to the shower curtain intermediate the top edge and the bottom edge; and a second weight element coupled to the weight end of the second elongated body and positioned below the rim outside the bathtub.

7. A shower curtain restrainer as claimed in claim 1 wherein the engagement member is coupled to the shower curtain intermediate the top edge and the bottom edge at a point on the shower curtain that is below the rim inside the bathtub.

8. A shower curtain restrainer as claimed in claim 7 wherein the bottom edge of the shower curtain is weighted to counteract an upward pulling force from the engagement member.

* * * * *